US005205636A

United States Patent [19]

Carpenter

[11] Patent Number: 5,205,636

[45] Date of Patent: Apr. 27, 1993

[54] ROTATING DISPLAY

[76] Inventor: Duane P. Carpenter, 3643 Lavell Dr., Los Angeles, Calif. 90065

[21] Appl. No.: 894,463

[22] Filed: Jun. 5, 1992

[51] Int. Cl.[5] ..... F21V 9/16

[52] U.S. Cl. ..... 362/84; 362/35; 472/61; 472/72

[58] Field of Search ..... 362/35, 84; 472/61, 472/72, 75

[56] References Cited

U.S. PATENT DOCUMENTS

| | | | |
|---|---|---|---|
| 3,245,310 | 4/1966 | Aldcroftt | 472/61 |
| 3,272,506 | 9/1966 | Lescher | 472/72 |
| 5,005,110 | 4/1991 | Brotz | 362/84 |

*Primary Examiner*—Carroll B. Dority
*Attorney, Agent, or Firm*—John P. McGonagle

[57] ABSTRACT

A visual effects producer employing a source of black light and a patterned rotating blade apparatus subject to fluorescence. The black light source and blade apparatus include variable intensity and speed controls whereby novel effects are provided.

14 Claims, 6 Drawing Sheets

0 - R.P.M.

500 - 1000 R.P.M.

1000 - 2000 R.P.M.

1:30 RATIO

1:4 RATIO

1:3 RATIO

1:1 RATIO

ROTATING DISPLAY

BACKGROUND OF THE INVENTION

This invention relates to ornamental or decorative illumination devices, and more particularly to psychedelic lighting devices. The devices may be termed visual works of art and are employed to create visual effects producing various sensations or moods in the mind of the observer.

Psychedelic lighting is characterized by intensified sensory perception, sometimes accompanied by significant perception distortion. When psychedelic lighting is integrated with a rotating display, dramatic visual effects may be obtained. Heretofore visual effect producers of various types have been known, as, for example, those including a source of visible light, the light source impinging its rays upon a patterned translucent film which is adapted for motion relative to the light source. As a result, the film transmits a luminous flux which varies with the variations of the pattern. Also, it is known to provide visual effects by employing a source of ultraviolet radiant energy which is outside of the visible spectrum, but which, when impinged on various materials, causes them to fluoresce. Such radiant energy is conventionally known as "black light," which term will be hereinafter employed. The black light source is employed in conjunction with the materials subject to fluorescence by employing the materials as coatings on various objects.

SUMMARY OF THE INVENTION

A principal object of the instant invention is the provision of a visual effects producer employing a source of black light and a patterned rotating blade apparatus subject to fluorescence.

In accordance with the instant invention, the black light source and apparatus include variable intensity and speed controls whereby novel effects are provided which heretofore have not been obtainable.

The construction and the effects of the instant invention herein described are different from previous patents. It is known that colored flat disks, cones, rotating cylinders, optical devices and concave rotating surfaces illuminated by a wide variety of lighting have been used in chromatic blenders, etc., to create certain color combinations and shading. See U.S. Pat. No. 1,547,864 (Etcheto) where colored changing rings appear to the viewer; U.S. Pat. No. 4,307,528 (Dewees) where a rotary reflector gives the illusion of light appearing to rotate in opposite directions; U.S. Pat. No. 2,107,860 (Gilbert) which discloses stationary cones on a planetary wheel that produces a variety of color blendings; U.S. Pat. No. 3,772,511 (Marban) in which flickering effects have been achieved by conventional light bulbs or the use of florescent black lighting described in U.S. Pat. No. 3,791,058 (Mollica). However, the visual effects from the instant invention have not been produced.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
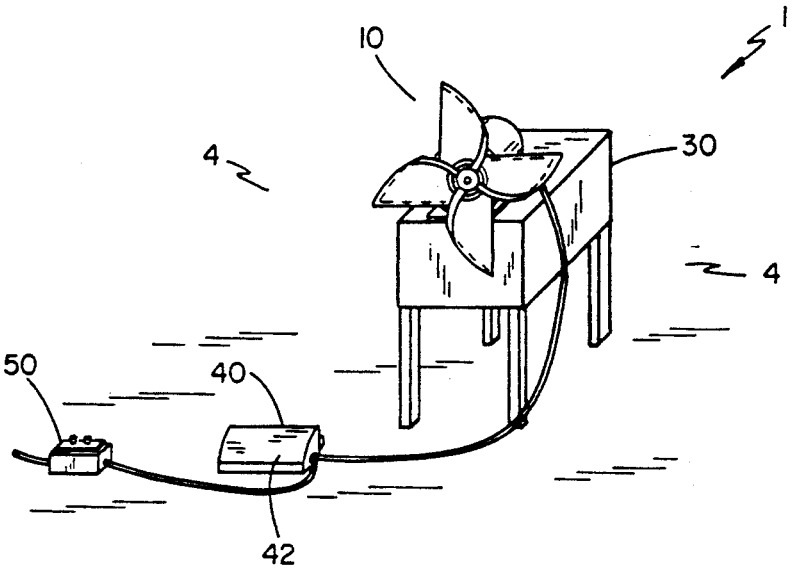
FIG. 1 is a perspective view of the invention.
Figure 2:
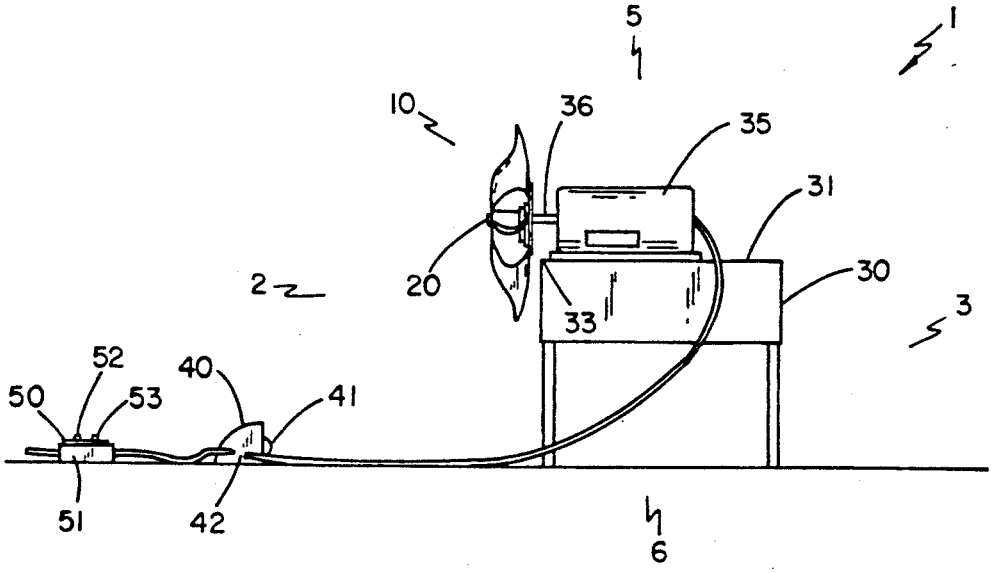
FIG. 2 is a side elevational view of the invention.
Figure 3:
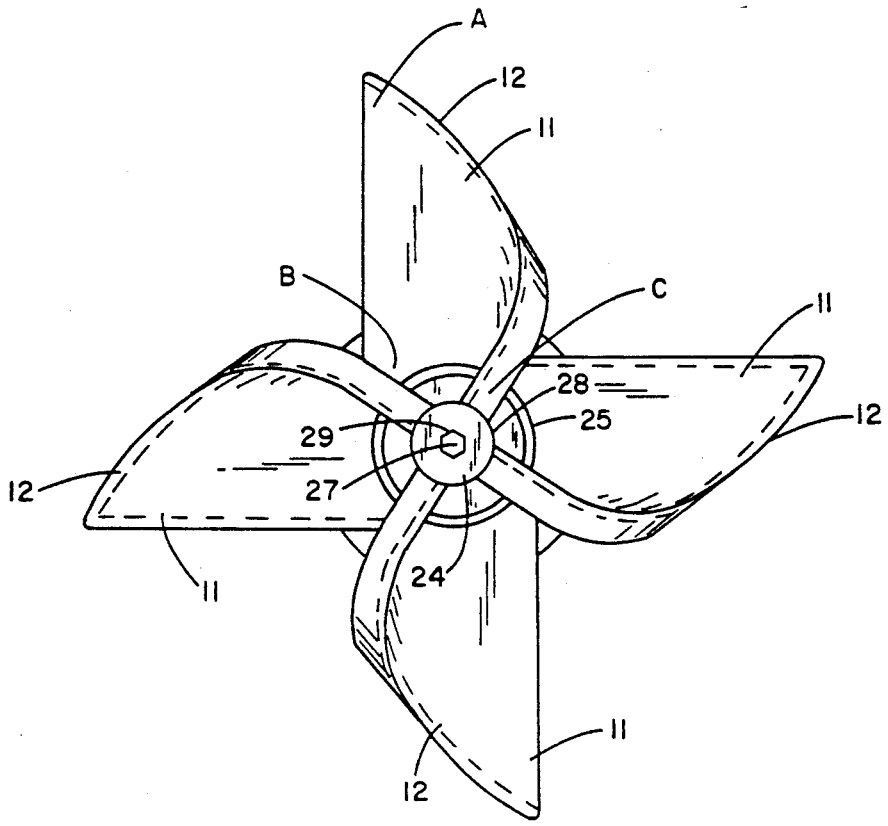
FIG. 3 is a front elevational view of the blade apparatus.
Figure 4:
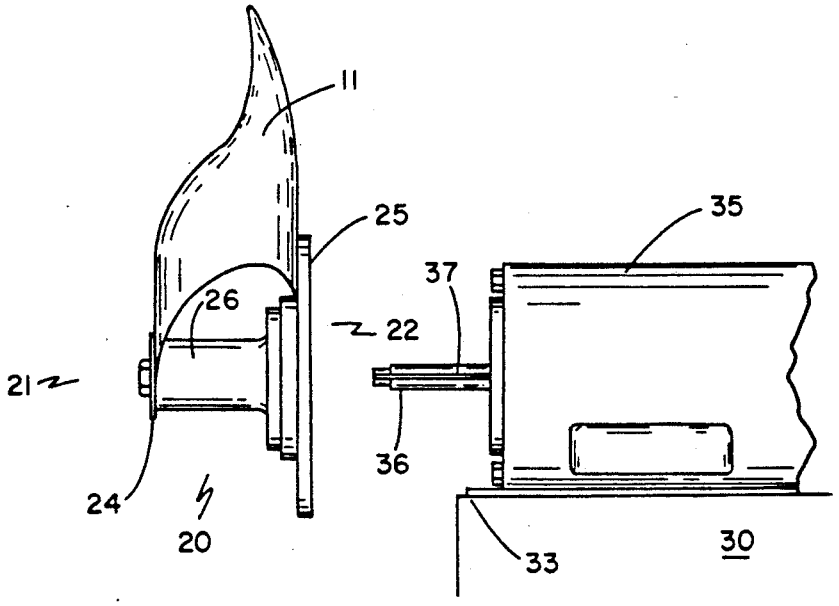
FIG. 4 is a side elevational view of a portion of the blade apparatus, partially exploded.
Figure 5A:
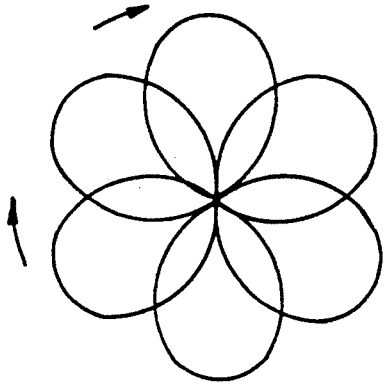
FIG. 5A is a front graphic illustration of blade assembly returned to a stable state after radical changes in light pulse to blade r.p.m. ratios.
Figure 5B:
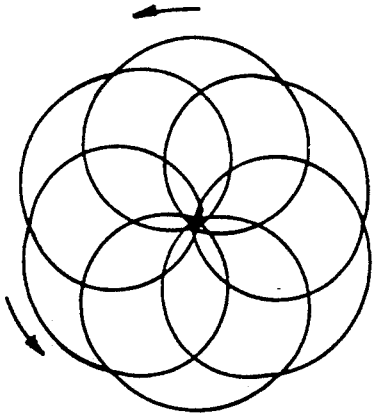
FIG. 5B is a front graphic illustration of blade assembly when in the process of returning to a stable state after radical changes in light pulse to blade r.p.m. ratios.
Figure 5C:
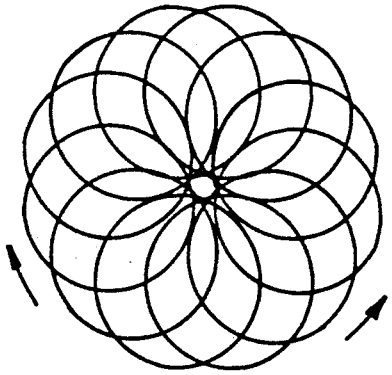
FIG. 5C is a front graphic illustration of blade assembly when beginning to return to a stable state after radical changes in light pulse to blade r.p.m. ratios.

Referring to the drawings in detail wherein like elements are indicated by like numerals, there is shown an embodiment of the invention 1 incorporating a rotating display. The invention has a front 2, back 3, two sides 4, top 5 and bottom 6. The invention is comprised of three major elements, a blade apparatus 10, a black light 40, and a control mechanism 50. The blade apparatus 10 is mounted on a platform or table 30 and is positioned so that it faces the front 2 of the invention 1. The blade apparatus 10 consists of four blades 11 made out of a thin, flexible plastic or similar material. In other embodiments, three blades or five blades could be used. The blades 11 rotate in a plane parallel to the front 2 of the invention 1 and are mounted on a hub 20 which in turn is connected to a variable speed motor 35 to the rear of the blade apparatus 10. The motor 35 is mounted on the top 31 of the table 30 near to the table's top front edge 33. The motor 35 provides rotational torque to the blades apparatus 10. The blade apparatus 10 and motor 35 may optionally be housed within a box (not shown) having an open front, back, top, bottom and two sides.

The general plane of the blades would be parallel to the box front plane. Regardless of whether a housing is used or not, the hub 20, motor 35 and table 30 are painted a flat black color. The blades 11 in this embodiment are painted a royal blue color. In addition, the blades 11 are patterned with fluorescent paint. The pattern is comprised of a red band near to the outer radial periphery 12 of the blades 11.

The hub 20 has a generally cylindrical shape with a front 21, middle portion 26 and a back 22, and a longitudinal axis in a front to back horizontal plane. The hub 20 also has an interior grooved opening (not shown) along its central longitudinal axis. The motor 35 has a direct drive arm 36 extending horizontally outward from the motor 35 toward the front 2 of the invention 1. The drive arm 36 is longitudinally grooved 37 and coacts with the groove in the interior hub opening when the hub 20 is slid onto the motor drive arm 36, thereby locking the hub 20 to the motor arm 36. The hub front 21 terminates in a plate 24 having a diameter slightly greater than the hub's cylindrical diameter. The hub rear 22 terminates in a plate 25 having a diameter approximately twice that of the hub's cylindrical diameter. The hub rear plate 25 has a central opening (not shown) corresponding to the interior opening of the hub. The hub front plate 24 is painted black. Its front face 28 has a small fluorescent orange circle 27 centrally located, and has a geometric design 29 made of fluorescent yellow painted on its face 28.

The blades 11 each have a triangular, pennant-like shape. The points 13 of each blade triangle may be defined as points A, B, and C. Point C has the smallest interior angle. Point B has the interior angle closest to ninety degrees. And Point A has an interior angle less than the interior angle of B but more than the interior angle of C. The triangular blade 11 is connected at point B to the hub's rear plate 25. Side B—A of the blade 11 extends radially outward from the rear plate 25 along a line approximately parallel to the radial axis of the rear plate 25. The blade 11 is then curved forwardly so that Point C is attached to the hub's front plate 24. Each of the blades 11 are attached in the same manner and are equispaced radially about the hub 20.

A black light source 40 is positioned approximately two feet in front and generally below the blade apparatus 10. The source 40 is aimed upwardly, approximately forty-five degrees at the blade hub 20. The source 40 in this embodiment is comprised of a twenty-four inch fluorescent black light blue bulb 41 in a conventional electrical circuit connected to a pulse generator (not shown) contained within a black light source housing 42.

The control mechanism 50 is comprised of a simple console 51 with two rotatable knobs 52, 53. The first knob 52 controls the rotational speed of the motor 35. The second knob 53 controls the pulsing rate of the bulb 41 by means of the pulse generator. Clockwise turns of the knobs 52, 53 increase speed or pulse rates. Counterclockwise turns decreases motor speed or pulse rates.

The construction of the blades 11 contributes to a series of new and unexpected effects. As stated above the curved surfaces of the blades 11 are made of flexible plastic which change shape and dimension depending on the rotational speed of the motor 35. When the blades 11 are initially set in motion, torque is created in which the first change in the flexible plastic blades take place. The blades 11 twist in a circular or counterclockwise fashion. When the rotational speed is reduced the blades 11 turn clockwise back towards their original forms.

Figure 6A:
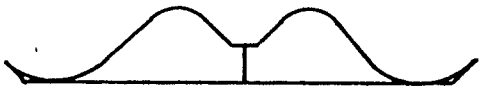
FIG. 6A is a top graphic illustration of the effects on the blade assembly from centrifugal and centripetal forces from 0–500 r.p.m. (revolutions per minute).
Figure 6B:
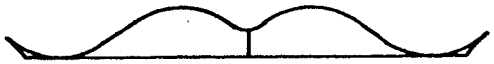
FIG. 6B is a top graphic illustration of the effects on the blade assembly from centrifugal and centripetal forces from 500 –1000 r.p.m.
Figure 6C:
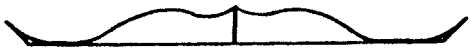
FIG. 6C is a top graphic illustration of the effects on the blade assembly from centrifugal and centripetal forces from 1000 –2000 r.p.m.

In addition to the above torque phenomena there is also an effect on the blades 11 from contradictory centrifugal (moving or directed outward from the center) and centripetal (directed toward the center) forces. When rotational speed is varied, the gravitational tendency to radially throw or push the flexible plastic construction out, i.e., flatten, at higher speeds or to radially pull inward when the speed of the blades is decreased causes the flexible plastic to be in a constant bouncing motion that gives the appearance of something animated, cellular or organic. The most striking impression is that it appears to be alive or breathing. FIGS. 6A, 6B and 6C best illustrate this effect.

Figure 7:
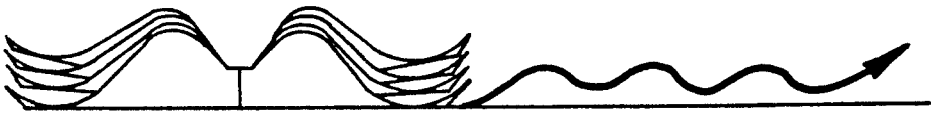
FIG. 7 is a top graphic illustration of the rocking motion of the blade assembly at full r.p.m.

A still additional effect is caused by the resistance of the turning blades and their appendages to the surrounding air. The curved surfaces of the blades are pointed in the opposite direction of a conventional air circulating fan. Instead of scooping or driving agitated air towards the operator, the curved appendages slide over and are pushed away from the air. When the blades are rotated at progressively higher speeds, the flexible blades and their appendages are forced out of wind resistance to contract or fold back towards the center point or hub. When the blades are rotated at even higher speeds, the flexible plastic construction begins to gently rock back and fourth in an unusual swaying motion and at maximum rotational speed the blades become violently agitated creating a whole new dynamic. FIG. 7 diagrammatically illustrates this phenomena.

When the effects described above are combined together, the resulting appearance is one of an oscillating breathing sphere that is vividly similar to transparent soap bubbles or fiery opalescent waves of scintillating light in which the viewer can look down through the ethereal composition as if it had many dimensions. The pictures formed in the center of the rotating blade apparatus are strikingly reminiscent of the shapes of living flowers viewed under time lapse photography that appear, dissolve, only to reappear.

To all the phenomena described above can be added the additional effect of the black light illuminating the blade apparatus 10. The black light shining on the blade apparatus 10 creates a lattice work of triangles of light and splinters of colored fragments cascading in and around the hub 20 of the rotating blades 11 and their outer peripheries 12 and also creates certain pools of congested effects. In these vibrational conditions color and forms do not stay as stationary petal formations nor do they simply dissolve into the homogeneous unity earlier described, but rather specific and newly colored overlapping light bands that are distinctly different from any previous phenomenon described are created. The colors and forms in these vibrational conditions run side by side in the same direction until a change in the ratio of light pulse rate and blade rotational speed is made and then run in opposite directions.

Figure 8:
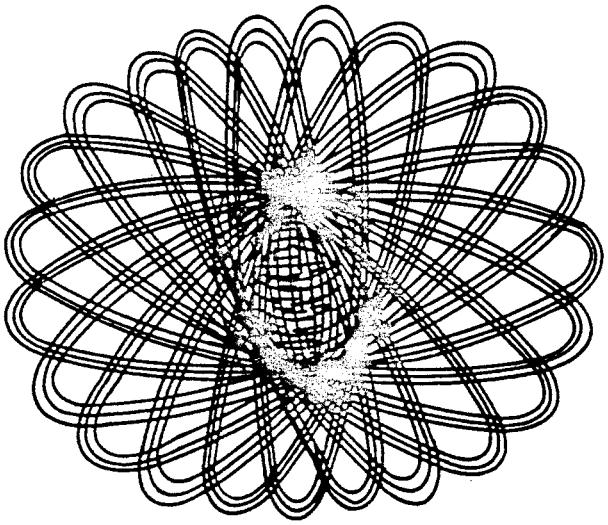
FIG. 8 is a front elevational view of a light pattern generated by the present invention during operation.
Figure 9D:
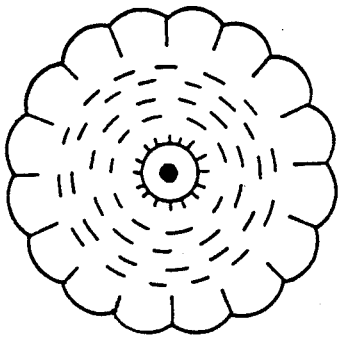
FIG. 9D is a front graphic illustration of the blade assembly when the ratio between light pulsing rate and blade r.p.m. is 30:1.
Figure 9C:
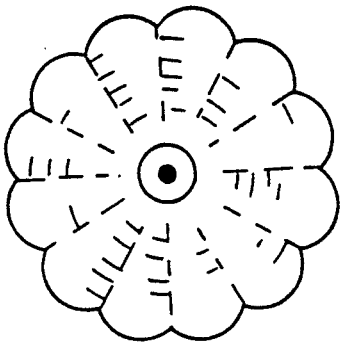
FIG. 9C is a front graphic illustration of the blade assembly when the ratio between light pulsing rate and blade r.p.m. is 4:1.
Figure 9B:
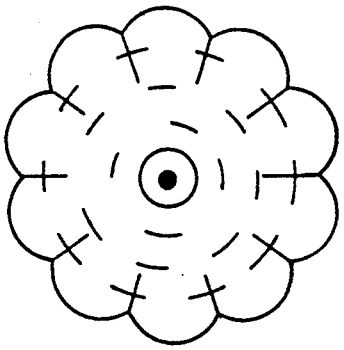
FIG. 9B is a front graphic illustration of the blade assembly when the ratio between light pulsing rate and blade r.p.m. is 3:1.
Figure 9A:
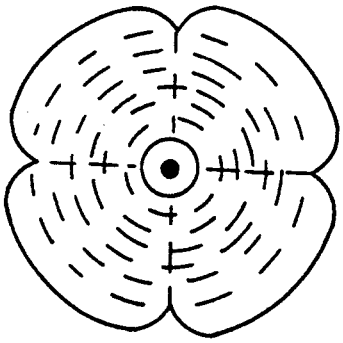
FIG. 9A is a front graphic illustration of the blade assembly when the ratio between light pulsing rate and blade r.p.m. is 1:1.

When the basic effects described above are combined with the control effects of the pulse generator working through the black light source 40, unexpected visual effects take place. The present invention may be superficially compared to the simple and one dimensional mechanics of the spirograph. When the speed of the rotating blades 11 is mathematically related to the flash of the pulsing light coming from the black light source 40, colored geometric patterns are created. Unlike the spirograph which can only create designs in a one dimensional and sequential order, the present invention can create an infinite variety of designs, one distinctly different from another. The present invention has the additional characteristic of being able to superimpose these designs simultaneously, one upon the other, in the same space and at the same time. It is this constant overlapping or overlaying of an infinite number of moving designs that gives the present invention an animated third and fourth dimensional effect. Visually, the observer may see a pattern as illustrated in FIG. 8.

Because of the speed at which this superimposition takes place and the infinite degrees of design and blending that are possible at any given moment, it is difficult to understand this ratio of light pulse to blade rotation without further explanation. At certain ratios of speed to pulse the rotating forms merge and reinforce each other. At other ratios of speed to pulse they cancel each other out creating new visual dynamics. Thus, around the circumference of the rotating blades 11 the overall pattern oscillates inwards and outwards to the visual eye thereby creating a variety of blended yet distinctive forms or divisions. These divisions are like the petals of a flower and conform to an algebraic formula, part of which is clearly obvious and can be controlled or regulated, and part of which is yet undefined because there are so many different factors involved.

As may be most clearly understood from an examination of FIGS. 9A–9D, if the four petals (blades 11) are exactly rotated to the same mathematical ratio of the pulse rate from the black light source 40 illuminating the surface of the blades, i.e., a 1:1 ratio, then the visual effect will be of a dancing and flashing design not unlike a four petalled flower. But as the ratio of pulse speed changes the four petals will change in appearance. At a ratio of 3:1, where the light is pulsing at three times the speed of the rotating petals, the four rotating blades 11 will appear as twelve petals. A further increase in the ratio to 4:1 will result in the appearance of a sixteen petalled flower. At a ratio of 30:1 there appears to be one hundred twenty petals.

During any changes of blade rotational speed to light pulse rate while the blades are in motion, the blades rotational direction will appear to change from clockwise to counterclockwise or vice versa. This in itself is not a unique effect. However, during radical changes in the ratio the effects from all of the factors described above produces a new visual effect. Specifically, if there is even the smallest change in the ratio of light pulse rate to blade rotational speed, the petals in multiples of four become superimposed upon each other so that what is viewed is that of a changing vortex or funnel of light. This effect, which can be regulated by the operator of the controls, is like a multidimensional kaleidoscope that can be seen first spiraling in towards the throat of the rotating blades and then out towards the outer periphery like an undulating transparent corkscrew. When the ratios of light pulse rate to blade rotational speed are radically altered the normal and more stable petal effects are even more violently thrown out of their normal balance. It is this wild gyration of motion in which the petal formations break down and a vortex or funnel effect begins to appear.

The creation and dissolution of light, color and form into rotating, cyclic and spiral motion is characteristic of cymatic (wave) effects. Colors, bands and ribbons of light can be controlled by an operator using the invention's control mechanism 50. By merely adjusting either the speed of blade rotation or the pulse rate of the black light source, the operator can cause the above described effects to cascade from the inside throat or diameter of the blade apparatus to its outer periphery only to spiral back again with a simple adjustment of the control mechanism. This inward and outward dynamic wave motion is particularly typical of the action of certain processes in nature such as wind currents, snow drifts, air and water flows, fluid dynamics and modern wave theories in physics. It is possible from the outline and description given for the operator of this invention to become a visual artist and learn to create an endless variety of dancing homogeneous forms of light and color just as a conventional artist can be trained to work with clay, tempera or oils.

It is understood that the above-described embodiment is merely illustrative of the application. Other embodiments may be readily devised by those skilled in the art which will embody the principles of the invention and fall within the spirit and scope thereof.

I claim:

1. A rotating display, having a front, back, two sides, top and bottom, comprising:

a platform;

a rotating blade apparatus mounted on said platform;

a black light shining on said blade apparatus; and a control mechanism connected to said blade apparatus and said black light for determining the speed of rotation of said blade apparatus and the intensity of said black light.

2. A rotating display as recited in claim 1, wherein:

said blade apparatus is positioned so that it faces out from the front of the display.

3. A rotating display as recited in claim 2, wherein said blade apparatus is comprised of:

a variable speed motor position blade apparatus, said motor being mounted on the top of the platform near to the platform top front edge;

a hub connected to said motor; and a plurality of blades made out of a thin, flexible material equispaced about and mounted on said hub and adapted to rotate in a plane parallel to the front of the display.

4. A rotating display as recited in claim 3, wherein:

said hub, motor and platform are painted a flat black color; and said blades are patterned with fluorescent paint.

5. A rotating display as recited in claim 4, wherein:

said hub has a generally hollow, cylindrical shape with a front, middle portion and a back, and a longitudinal axis in a front to back horizontal plane, said hub front terminating in a front plate having a diameter slightly greater than the hub's cylindrical diameter, said hub back terminating in a rear plate having a diameter approximately twice that of the hub s cylindrical diameter, said hub rear plate having a central opening corresponding to the interior opening of the hub.

6. A rotating display as recited in claim 5, wherein:

said hub front plate has a front face and a rear face, and is painted black, said front face also having a small fluorescent orange circle centrally located painted thereon, and also having a fluorescent yellow geometric design painted on its face.

7. A rotating display as recited in claim 6, wherein:

said hub has an interior longitudinal grooved opening along its central longitudinal axis; and said motor has a direct drive arm extending horizontally outward from the motor toward the front of the display, said drive arm being longitudinally grooved and coacting with the groove in the interior hub opening;

wherein said hub is positioned onto the motor drive arm, thereby locking the hub to the motor arm.

8. A rotating display as recited in claim 7, wherein:

said blades each have a triangular, pennant-like shape, the points of each blade triangle being defined as points A, B, and C, said point C having the smallest interior angle, said point B having the interior angle closest to ninety degrees, and said point A having an interior angle less than the interior angle of B but more than the interior angle of C.

9. A rotating display as recited in claim 8, wherein:

each triangular blade is connected at point B to the hub's rear plate and at point C to the hub's front plate, wherein side B—A of the blade extends radially outward from the rear plate along a line approximately parallel to the radial axis of the rear plate.

10. A rotating display as recited in claim 9, wherein:

said black light is positioned in front and generally below the blade apparatus, said light being aimed upwardly, approximately forty-five degrees at the blade hub.

11. A rotating display as recited in claim 10, wherein:

said black light is comprised of a fluorescent black light blue bulb in a conventional electrical circuit connected to a pulse generator contained within a black light source housing.

12. A rotating display as recited in claim 11, wherein:

said control mechanism is comprised of a console with two rotatable knobs, said first knob adjusting the rotational speed of the motor, and said second knob controlling the pulsing rate of the bulb by means adjustments to the pulse generator.

13. A rotating display as recited in claim 12, wherein:

said blades are painted a royal blue color.

14. A rotating display as recited in claim 13, wherein:

said blade fluorescent pattern is comprised of a red band near to the outer radial periphery of the blades.

* * * * *